US006354454B1

(12) United States Patent
Wong

(10) Patent No.: US 6,354,454 B1
(45) Date of Patent: Mar. 12, 2002

(54) BOTTLE CAP

(76) Inventor: Tommy Chi-Kin Wong, RM. 1901, Win Century Centre 2A, Mongkok Rd., Kowloon (HK)

( * ) Notice: Subject to any disclaimer, the term of this patent is extended or adjusted under 35 U.S.C. 154(b) by 0 days.

(21) Appl. No.: 09/599,008

(22) Filed: Jun. 22, 2000

(30) Foreign Application Priority Data

Apr. 28, 2000 (TW) ..... 89207042

(51) Int. Cl.[7] ..... B65D 43/20

(52) U.S. Cl. ..... 220/345.1; 220/345.4; 220/254; 215/322; 222/560

(58) Field of Search ..... 215/236, 322; 220/820, 824, 345.1, 345.4, 254; 222/559, 561, 560

(56) References Cited

U.S. PATENT DOCUMENTS 1,765,284 A * 6/1930 Prosnitz
1,815,069 A * 7/1931 Petro ..... 220/345.1
2,073,707 A * 3/1937 Parkin
2,152,271 A * 3/1939 Nyden
2,159,978 A * 5/1939 Parkin
2,304,214 A * 12/1942 Straub
2,480,733 A * 8/1949 Hermani
2,575,083 A * 11/1951 Abraham
2,575,106 A * 11/1951 Hermani
2,757,859 A * 8/1956 Holland
4,201,320 A * 5/1980 Eppenbach

* cited by examiner

*Primary Examiner*—Nathan J. Newhouse
(74) *Attorney, Agent, or Firm*—Rabin & Berdo, P.C.

(57) ABSTRACT

A bottle cap with improved structure includes a special cap that covers the container and prevents the liquid inside from spills. A hollow arch is mounted on the top of the cap with a hole (i.e., mouth of the container) and a rectangle slot cut out of the top thereof. An arched sliding board is arranged just below the rectangle slot. The sliding board shifts along the two side of the rectangle slot to determine the size of the hole opened.

2 Claims, 4 Drawing Sheets

BOTTLE CAP

BACKGROUND OF THE INVENTION

I. Field of the Invention

This invention relates generally to a bottle cap with an advanced design and, more specifically, to a bottle cap with a simple and easy-to-assemble structure. Users hold the body of the container with only one hand and adjust the bulge bar on the sliding board with their forefinger, which, in turn, determines the degree to which the hole is opened as well as the flow of the liquid poured from the container.

II. Description of the Prior Art

It is known to construct a container having a bottle cap opened by turning or lifting its cap. A typical bottle cap of such construction does not allow users to adjust the degree to which the cap is opened. Hence, users are unable to freely determine the flow of liquid poured from the container at each time.

SUMMARY OF THE INVENTION

It is therefore a primary object of the present invention to provide an improved structure for the bottle cap so that users can easily adjust the cap and determine the amount of flow of the liquid with a single hand.

In accordance with the present invention, there is provided a bottle cap comprising a special cap that covers the container and prevents the liquid inside from spilling. This cap features a hollow arch bulged on the central top of the cap, with a hole and a rectangular slot located on the top of the arch. The hole is mounted at one end of the arch, and the rectangular slot is near the center of the arch, next to the hole. The area between the hole and the slot is a locating plane. An arched sliding board is disposed below the rectangular slot with a bulge bar on its top, and a locating board is mounted between the arched sliding board and the rectangular slot. The sliding board shifts along the arch as the bulge bar is moved back and forth between the two sides of the rectangular slot, which, in turn, opens or shuts the hole.

While operating a container of the present prevention, users hold the body and move the bulge bar on the arched sliding board with their forefinger go as to adjust the degree to which the hole is opened. Therefore, the flow of the liquid poured from the bottle can be controlled.

For a better understanding of the invention, reference will now be made by way of example to the accompanying drawings in which:

DESCRIPTION OF THE PREFERRED EMBODIMENT

Figure 1:
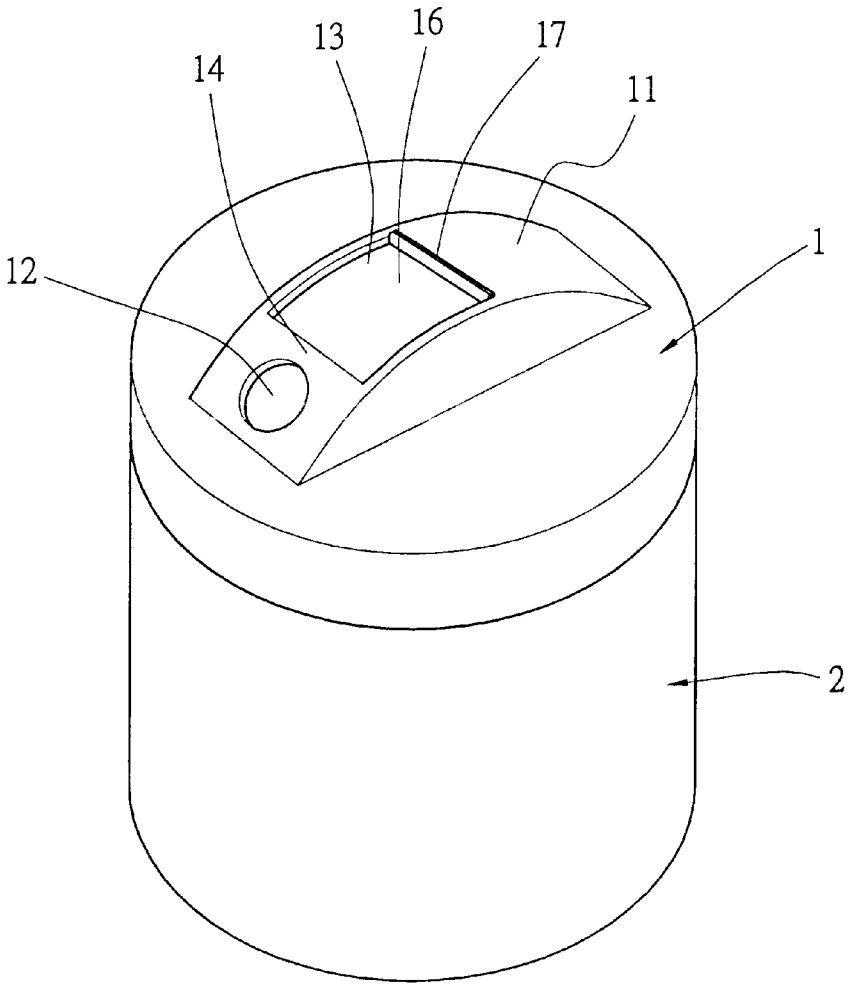
FIG. 1 is a perspective view of the embodiment of the present invention.
Figure 2:
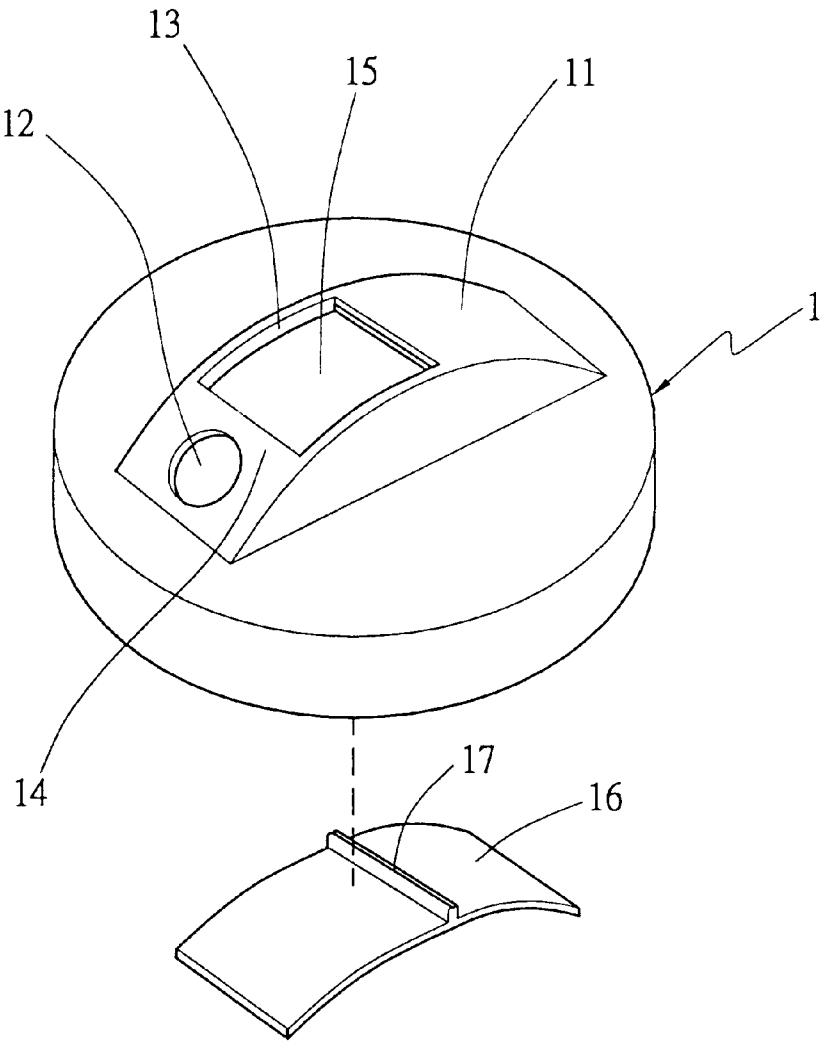
FIG. 2 is an exploded view of the present invention.
Figure 3:
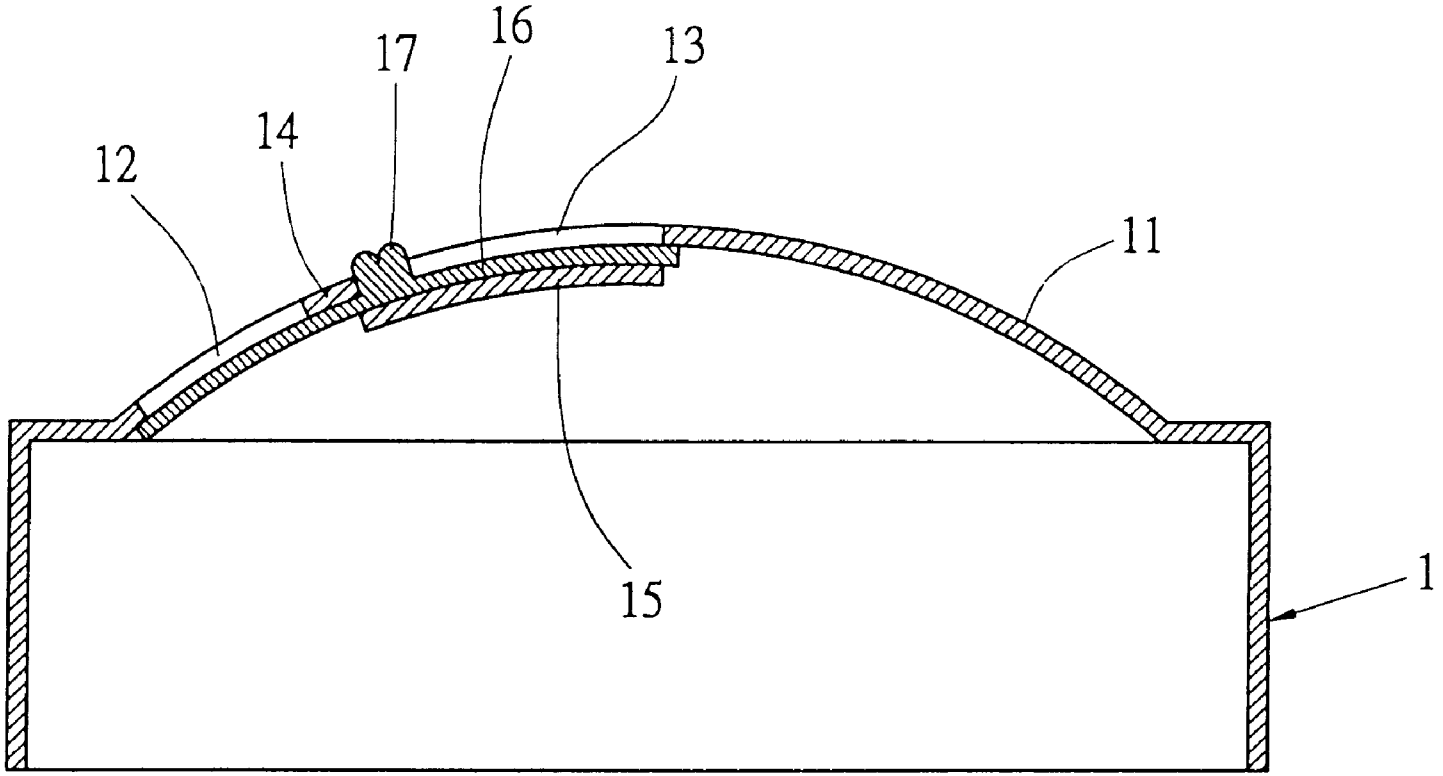
FIG. 3 is a sectional view of the present invention.

Referring to the drawings, the bottle cap of the present invention includes a cap 1 that covers a container 2 to prevent the liquid inside the container 2 from spilling. A hollow arch 11 is mounted on the central top of the cap 1, with a hole 12 mounted on the top of the arch at one end, as well as a rectangular slot 13 next to the hole disposed on the middle part of the cap 1. The area of the cap between the hole 12 and the slot 13 forms a locating plane 14.

An arched sliding board 16 is mounted below the hole 12 and the rectangular slot 13. A bulge bar 17 is disposed on the top of the sliding board 16 and at the same time inside the rectangle slot 13. As the bulge bar 17 moves back and forth in the slot 13 along the arch, the underlying sliding board 16 opens or closes the hole 12. A locating board 15 is arranged on the bottom of the sliding board 16 at the position under the rectangular slot 13.

The arched sliding board 16 is mounted between the inner surface of the hollow arch 11 and the locating board 15. The arch of the sliding board 16 fits well with the arch of the hollow arch 11 in terms of width and curve. As the bulge bar 17 on the sliding board 16 is shifted within the rectangular slot 13, due to the disposition of the locating plane 14, the movement of the sliding board 16 is limited; thus the size of the hole being opened can be controlled.

Another embodiment of the present invention is to arrange protruding markings at equal intervals on the bottom or lateral side of the rectangular slot 13 as well as of the sliding board 16 at the corresponding side, or on the bulge bar 17. Because the protruding markings are perpendicular to the shifting directions of the sliding board 16, when the sliding board 16 is moved, the markings on the rectangular slot 13 and the sliding board 16 slightly wedge each other and thus allow users to precisely adjust the position of the sliding board 16 and control the degree to which the hole 12 is opened.

Figure 4:
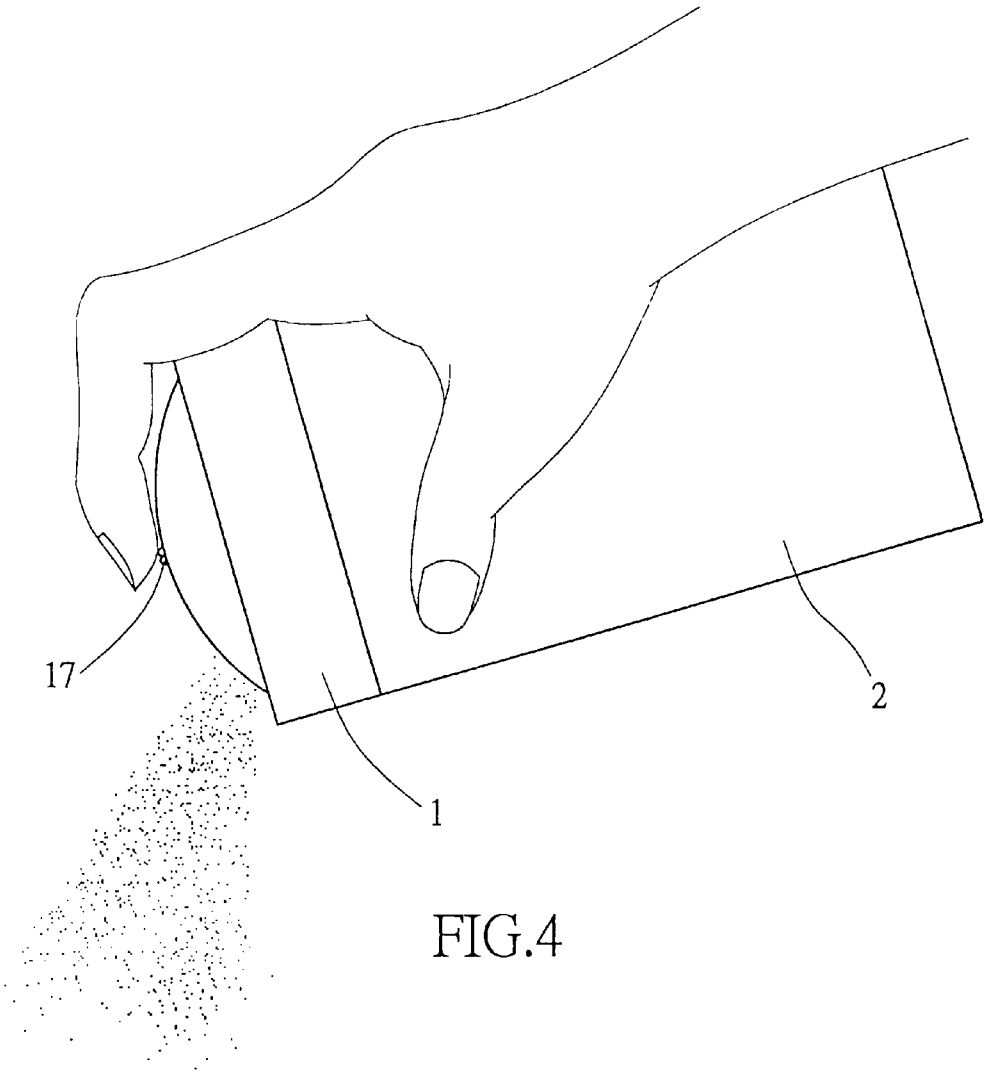
FIG. 4 is a schematic diagram of one embodiment of the present invention.

As shown in FIG. 4, when operating a bottle with the present invention, users need to hold the body of the bottle with only a single hand; thus the position of the arched sliding board 16 can be adjusted with their forefinger pushing or pulling the bulge bar 17 on the sliding board 16. With the present invention, users can easily and precisely adjust the size of the hole 12 opened and thus are able to pour the liquid from the bottle 2 in the desired amount. Therefore, the present invention has the advantage of low cost due to the simplicity of design and easy assembling.

What is claimed is:

1. A bottle cap, comprising:

a cap portion adapted to cover a container to prevent contents inside the container from spilling;

a hollow arch mounted on a central top of said cap portion, said hollow arch having a hole at one end thereof, and having a rectangular slot next to said hole and disposed on a middle part of said cap portion so that an area of said cap portion between said hole and said slot forms a locating plane;

a locating board fixed at lateral sides thereof to said hollow arch and being arranged just below said rectangular slot; and an arched sliding board mounted between said slot and said locating board, and having a bulge bar arranged on a top thereof, said bulge bar being inside said rectangular to allow said arched sliding board be moved inside said rectangular slot backwards or forwards in order to control an amount said hole is opened.

2. A bottle cap, comprising:

a cap portion adapted to cover a container to prevent contents inside the container from spilling;

a hollow convex arch mounted on a top portion of said cap portion, said hollow convex arch having a hole at one end thereof, and having a slot next to the hole, said hollow convex arch having an inner surface;

a convexly-arched locating board fixed at lateral sides thereof to said hollow convex arch, said locating board having an upper surface that is disposed directly below the slot, and beneath the inner surface of said hollow convex arch to form a space therebetween; and a convexly-arched sliding board slidably supported on said locating board and being disposed in the space so that an upper surface of said sliding board is in contact with the inner surface of said hollow convex arch, and a lower surface of said sliding board is in contact with the upper surface of said locating board, said sliding board having a bulge bar arranged on a top surface thereof, said bulge bar being inside said slot to allow said arched sliding board to be moved inside said slot backwards or forwards in order to control an amount the hole is opened.

* * * * *